US009708964B2

(12) United States Patent
Amano et al.

(10) Patent No.: US 9,708,964 B2
(45) Date of Patent: Jul. 18, 2017

(54) COOLING APPARATUS FOR ENGINE

(71) Applicant: TOYOTA JIDOSHA KABUSHIKI KAISHA, Toyota-shi, Aichi (JP)

(72) Inventors: Takashi Amano, Susono (JP); Hidefumi Aikawa, Suntou-gun (JP); Kojiro Hayakawa, Suntou-gun (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 91 days.

(21) Appl. No.: 14/657,067

(22) Filed: Mar. 13, 2015

(65) Prior Publication Data

US 2015/0267602 A1 Sep. 24, 2015

(30) Foreign Application Priority Data

Mar. 24, 2014 (JP) ..... 2014-060459

(51) Int. Cl.
*F01P 7/14* (2006.01)
*F01P 3/02* (2006.01)
(Continued)

(52) U.S. Cl.
CPC *F01P 7/14* (2013.01); *F01P 3/02* (2013.01); *F01P 3/20* (2013.01); *F01P 5/10* (2013.01);
(Continued)

(58) Field of Classification Search
CPC ..... F01P 3/20; F01P 2003/027; F01P 26/28; F01P 2007/143; F01P 2007/146;
(Continued)

(56) References Cited

U.S. PATENT DOCUMENTS 6,321,697 B1 * 11/2001 Matsuda ..... F01P 7/165 123/41.29
6,568,356 B1 * 5/2003 Hayakawa ..... F01P 7/167 123/41.1
(Continued)

FOREIGN PATENT DOCUMENTS

JP 2013-087761 A 5/2013
JP 2013-127224 A 6/2013

*Primary Examiner* — Erick Solis
*Assistant Examiner* — Robert Werner
(74) *Attorney, Agent, or Firm* — Andrews Kurth Kenyon LLP

(57) ABSTRACT

A cooling apparatus comprises a first cooling conduit branching off from a downstream side connection conduit to cool the cylinder head, a second cooling conduit branching off from the downstream side connection conduit, is provided in parallel with the first cooling conduit, an intermediate cooling conduit being connected to the first and second cooling conduits, is provided with an EGR cooler, a third cooling conduit running from a connection point of the intermediate cooling conduit and the first cooling conduit to an upstream side connection conduit, a fourth cooling conduit running from a connection point of the intermediate cooling conduit and the second cooling conduit to the upstream side connection conduit, and a changeover valve for adjusting the flow resistance of the second cooling conduit. And the direction of coolant flow in the intermediate cooling conduit is changed over by operating the changeover valve.

6 Claims, 8 Drawing Sheets

(51) Int. Cl.
*F01P 3/20* (2006.01)
*F01P 5/10* (2006.01)
*F02M 26/28* (2016.01)

(52) U.S. Cl.
CPC ..... *F02M 26/28* (2016.02); *F01P 2003/027* (2013.01); *F01P 2007/143* (2013.01); *F01P 2007/146* (2013.01); *F01P 2060/00* (2013.01)

(58) Field of Classification Search
CPC ..... F01P 2031/00; F01P 2031/20; F01P 2031/22; F01P 2025/34; F01P 2025/36; F01P 2025/52; F01P 7/165
USPC ..... 123/41.29, 568.12
See application file for complete search history.

(56) References Cited

U.S. PATENT DOCUMENTS

| | | | | |
|---|---|---|---|---|
| 6,679,202 | B2 * | 1/2004 | Nakano | F01P 5/14 123/41.1 |
| 8,146,542 | B2 * | 4/2012 | Cattani | F01P 3/12 123/41.1 |
| 8,434,432 | B2 * | 5/2013 | Magro | F01N 3/04 123/41.1 |
| 2011/0041814 | A1 * | 2/2011 | Kardos | F01P 7/165 123/563 |
| 2011/0088668 | A1 * | 4/2011 | Kardos | F02B 29/0412 123/563 |
| 2013/0160723 | A1 | 6/2013 | Miyagawa | |

* cited by examiner

| Changeover Valve Installation Area | State of Changeover Valve | |
|---|---|---|
| | Opening Position | Closing Position |
| A | (1) | (2) |
| D | (1) | (2) |
| C | (2) | (1) |
| B | (2) | (1) |

COOLING APPARATUS FOR ENGINE

TECHNICAL FIELD

The present invention relates to a cooling apparatus for an engine, which cools the engine main body and a device to be cooled by employing a cooling path through which coolant flows to circulate.

BACKGROUND ART

A cooling apparatus for an engine is per se known that cools the cylinder block and the cylinder head of the engine separately, that includes two cooling conduits communicated to an EGR cooler, and that changes the cooling paths employed for cooling the EGR cooler by operating valves, one provided in each of the cooling conduits (refer to Patent Document #1). Moreover, Patent Document #2 is a reference that is considered to have some relevance to the present invention.

CITATION LIST

Patent Literature

Patent Document #1: Japanese Laid-Open Patent Publication 2013-87761.

Patent Document #2: Japanese Laid-Open Patent Publication 2013-127224.

SUMMARY OF INVENTION

Technical Problem

Since, with the cooling apparatus of Patent Document #1, valves are provided for changing over the two cooling conduits, one in each of the conduits, accordingly, along with the number of components being increased, also if a fault occurs in one or the other of the valves, labor is required for dealing with that fault.

Thus, it is the object of the present invention to provide a cooling apparatus for an engine, which is capable of cooling a device to be cooled effectively with a simple structure.

Solution to Technical Problem

A cooling apparatus as one aspect of the present invention is a cooling apparatus for an engine that employs a cooling path through which coolant flows to circulate by a coolant pump, and that cools an engine main body and a device to be cooled, wherein: the cooling path comprises a downstream side connection conduit that is connected to a downstream side of the coolant pump, an upstream side connection conduit that is connected to an upstream side of the coolant pump, a first cooling conduit that branches off from the downstream side connection conduit and cools at least one portion of the engine main body, a second cooling conduit that branches off from the downstream side connection conduit and is provided in parallel with the first cooling conduit, an intermediate cooling conduit that is connected to the first cooling conduit and to the second cooling conduit and is provided with the device to be cooled, a third cooling conduit that runs from a position of connection of the intermediate cooling conduit and the first cooling conduit to the upstream side connection conduit, and a fourth cooling conduit that runs from a position of connection of the intermediate cooling conduit and the second cooling conduit to the upstream side connection conduit; a flow resistance regulation device is included that is capable of regulating flow resistance, provided in any one of the first cooling conduit, the second cooling conduit, the third cooling conduit, and the fourth cooling conduit; and due to a movement of the flow resistance regulation device, a direction in which coolant flows in the intermediate cooling conduit is changed over between a first direction from the first cooling conduit towards the second cooling conduit, and a second direction from the second cooling conduit towards the first cooling conduit.

According to this cooling apparatus, it is possible to change the proportion between the flow resistances of the cooling conduits by the movement of the flow resistance regulation device provided in any one of the first through the fourth cooling conduits that are connected to the intermediate cooling conduit that conducts coolant to the device to be cooled. Due to this, it is possible to change over the direction in which coolant flows in the intermediate conduit between the first direction from the first cooling conduit toward the second cooling conduit, and the second direction from the second cooling conduit toward the first cooling conduit. Thereby, it is possible to cool the device to be cooled with a simple structure and moreover in an efficient manner.

As one specialized aspect of the cooling apparatus of the present invention, a changeover valve may be provided as the flow resistance regulation device, and: under a condition that the changeover valve is provided in the first cooling conduit or in the fourth cooling conduit, the flow resistances of the first cooling conduit, the second cooling conduit, the third cooling conduit and the fourth cooling conduit may be set so that coolant flows in the intermediate cooling conduit in the first direction when the changeover valve is at a valve opening position; while, under a condition that the changeover valve is provided in the second cooling conduit or in the third cooling conduit, the flow resistances of the first cooling conduit, the second cooling conduit, the third cooling conduit and the fourth cooling conduit may be set so that coolant flows in the intermediate cooling conduit in the second direction when the changeover valve is at the valve opening position. According to this aspect of the present invention, under a condition that the changeover valve is provided in the first cooling conduit or in the fourth cooling conduit, then it is possible to change over the direction in which coolant flows in the intermediate cooling conduit from the first direction to the second direction by changing the proportion of the flow resistances by increasing the flow resistance of the first cooling conduit or of the fourth cooling conduit by changing over the state of the changeover valve from the valve opening position to a valve closing position. In a similar manner, under a condition that the changeover valve is provided in the second cooling conduit or in the third cooling conduit, then it is possible to change over the direction in which coolant flows in the intermediate cooling conduit from the second direction to the second direction by changing the proportion of the flow resistances by increasing the flow resistance of the second cooling conduit or of the third cooling conduit by changing over the state of the changeover valve from the valve opening position to the valve closing position.

And, as another specialized aspect of the cooling apparatus of the present invention, there may be further included a computer that implements a computer program to function as: an operating device configured to operate the flow resistance regulation device; and a diagnosis device configured to determine an anomaly of the flow resistance regulation device on the basis of correlation between operation to the flow resistance regulation device and change of temperature or of pressure within the intermediate cooling conduit. If there is an anomaly of the flow resistance regulation device, then no change of the pressure or of the temperature within the intermediate cooling conduit will occur between a moment before the operation of the flow resistance regulation device and a moment after the operation. According to this aspect of the present invention, it is possible to determine as to an anomaly of the flow resistance regulation device, on the basis of correlation between the operation to the flow resistance regulation device and the change of the pressure or of the temperature within the intermediate cooling conduit, even without actually detecting a movement of the flow resistance regulation device itself as such.

And, as yet another specialized aspect of the cooling apparatus of the present invention, the engine main body may include a cylinder head and a cylinder block, the device to be cooled may be an EGR cooler, and the first cooling conduit may cool the cylinder head while the second cooling conduit cools the cylinder block. According to this aspect of the present invention, by changing over the direction of the coolant that is flowing to the EGR cooler, which is the device to be cooled, it is possible to change over between a state in which coolant that has passed through the cylinder head and that is at comparatively high temperature is supplied to the EGR cooler, and a state in which coolant that has passed through the cylinder block and that is at comparatively low temperature is supplied to the EGR cooler.

DESCRIPTION OF EMBODIMENTS

Embodiment #1

Figure 1:
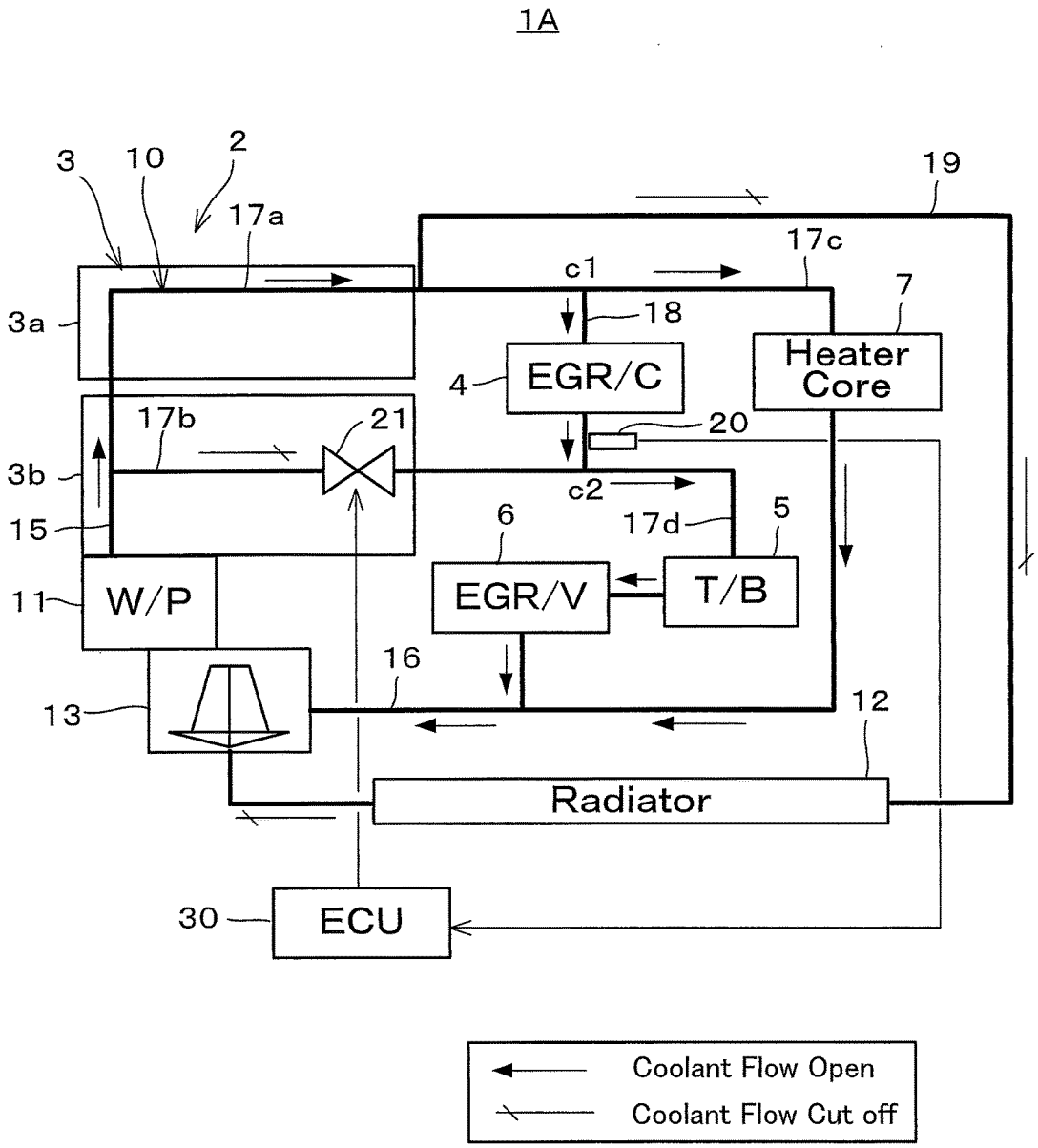
FIG. 1 is a figure schematically showing a cooling apparatus for an engine according to a first embodiment of the present invention.

As shown in FIG. 1, a cooling apparatus 1A is installed to an engine 2 that is built as a reciprocating internal combustion engine. This cooling apparatus 1A cools the engine main body 3 and an EGR cooler 4, a turbine 5, an EGR valve 6 and so on, which are auxiliary devices of the engine 2. Moreover, the cooling apparatus 1A is also used for supplying heat to a heater core 7 that is used for air-conditioning of a vehicle (not shown in the figures) to which the engine 2 is mounted. The cooling apparatus 1A comprises a cooling path 10 through which coolant circulates, a coolant pump 11 for causing the coolant to circulate in the cooling path 10, a radiator 12 that performs heat exchange between the coolant and the external air, and a thermostat 13 for changing over the flow of coolant to the radiator 12 between being open and being blocked.

The cooling path 10 includes a downstream side connection conduit 15 that is connected to the downstream side of the coolant pump 11, and an upstream side connection conduit 16 that is connected to the upstream side of the coolant pump 11. Moreover, the cooling path 10 comprises: a first cooling conduit 17*a* that branches off from the downstream side connection conduit 15 and cools a cylinder head 3*a* of the engine main body 3; a second cooling conduit 17*b* that branches off from the downstream side connection conduit 15 and is provided in parallel with the first cooling conduit 17*a* and cools a cylinder block 3*b* of the engine main body 3; an intermediate cooling conduit 18 that is connected to the first cooling conduit 17*a* and to the second cooling conduit 17*b*, and is provided with an EGR cooler 4 that constitutes a device to be cooled; a third cooling conduit 17*c* that runs from the position of connection c1 of the first cooling conduit 17*a* and the intermediate cooling conduit 18 to the upstream side connection conduit 16; and a fourth cooling conduit 17*d* that runs from the position of connection c2 of the intermediate cooling conduit 18 and the second cooling conduit 17*b* to the upstream side connection conduit 16. Since the first cooling conduit 17*a* passes through the cylinder head 3*a* while the second cooling conduit 17*b* passes through the cylinder block 3*b*, accordingly the first cooling conduit 17*a* may be considered as being a cooling conduit that receives a substantially greater amount of heat into its coolant than does the second cooling conduit 17*b*.

A radiator flow path 19 branches off from the first cooling conduit 17*a*, and this radiator flow path 19 comes together with the upstream side connection conduit 16. A thermostat 13 is provided at the position where the radiator flow path 19 and the upstream side connection conduit 16 come together. If the temperature of the coolant is less than or equal to the set temperature of the thermostat 13, then the thermostat 13 is kept in a closed state and the radiator flow path 19 is closed while the upstream side connection conduit 16 is opened. A temperature sensor 20 that outputs a signal corresponding to the temperature of the coolant is provided in the intermediate cooling conduit 18.

Figure 2:
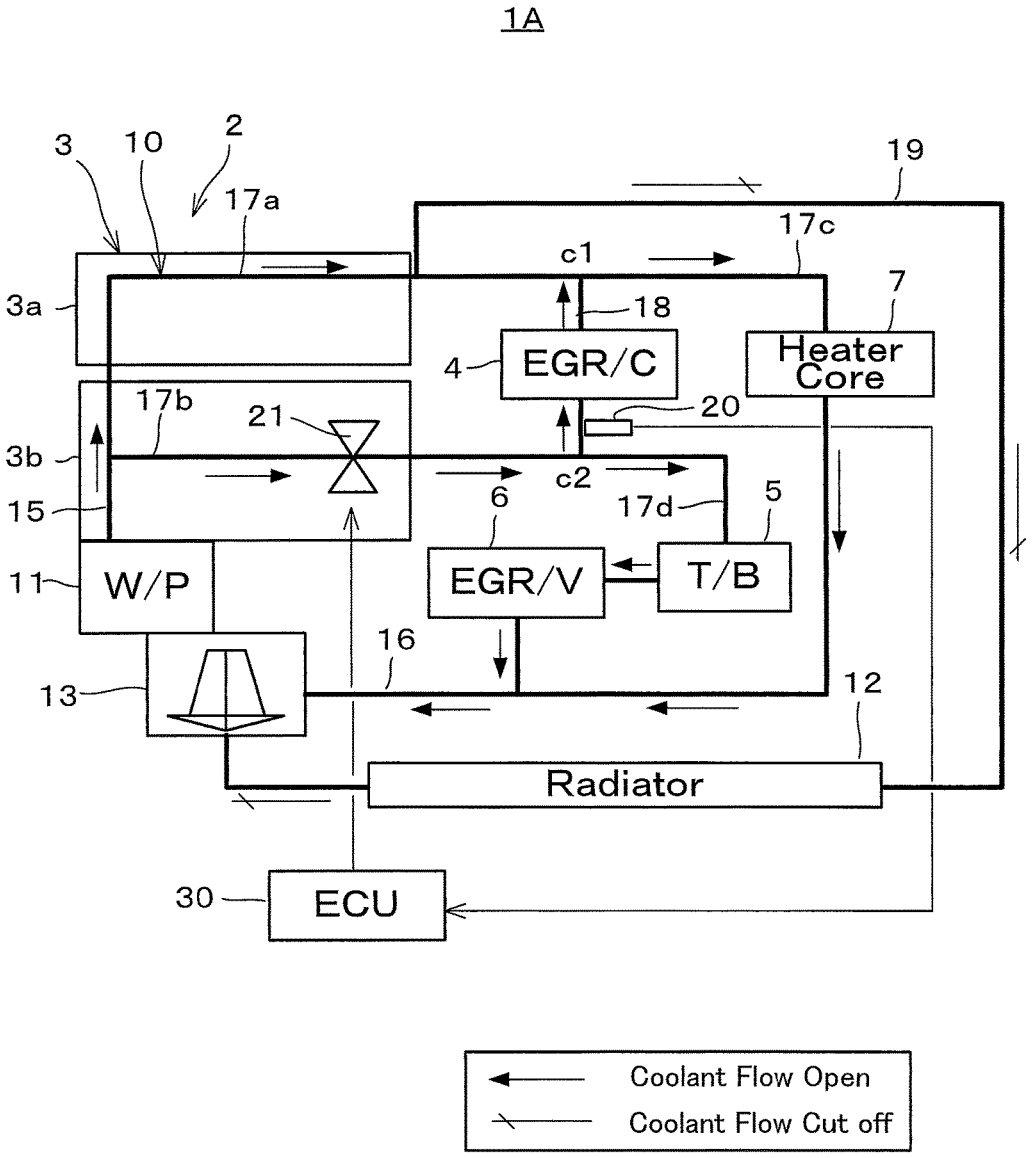
FIG. 2 is a figure showing a state of the cooling apparatus of FIG. 1, in which the direction of coolant flowing in an intermediate cooling conduit is changed over.

A changeover valve 21 is provided in the second cooling conduit 17*b*, and this valve 21 serves as a flow resistance regulation device. The changeover valve 21 is built as an electromagnetic valve of a two-position type, and can change over its state between a valve closing position shown in FIG. 1 in which the second cooling conduit 17*b* is closed and a valve opening position shown in FIG. 2 in which the second cooling conduit 17*b* is opened. When the changeover valve 21 is operated to change over its state to the valve closing position as shown in FIG. 1, then, the first cooling conduit 17*a* is opened while the second cooling conduit 17*b* is closed. Thereby, the direction of flow of coolant in the intermediate cooling conduit 18 to which these cooling conduits 17*a* and 17*b* are connected becomes a first direction, i.e. from the first cooling conduit 17*a* toward the second cooling conduit 17*b*. On the other hand, when the changeover valve 21 is operated to change over its state to the valve opening position as shown in FIG. 2, then, according to a predetermined proportion of flow resistances of the conduits which is set in advance, the direction of flow of coolant in the intermediate cooling conduit 18 to which these cooling conduits 17*a* and 17*b* are connected is reversed, and becomes a second direction, i.e. from the second cooling conduit 17*b* toward the first cooling conduit 17*a*. Accordingly it is possible to change over the direction of coolant flow in the intermediate cooling conduit 18 between the first direction and the second direction by operating the state of the changeover valve 21 between the valve closing position and the valve opening position.

Figure 3:
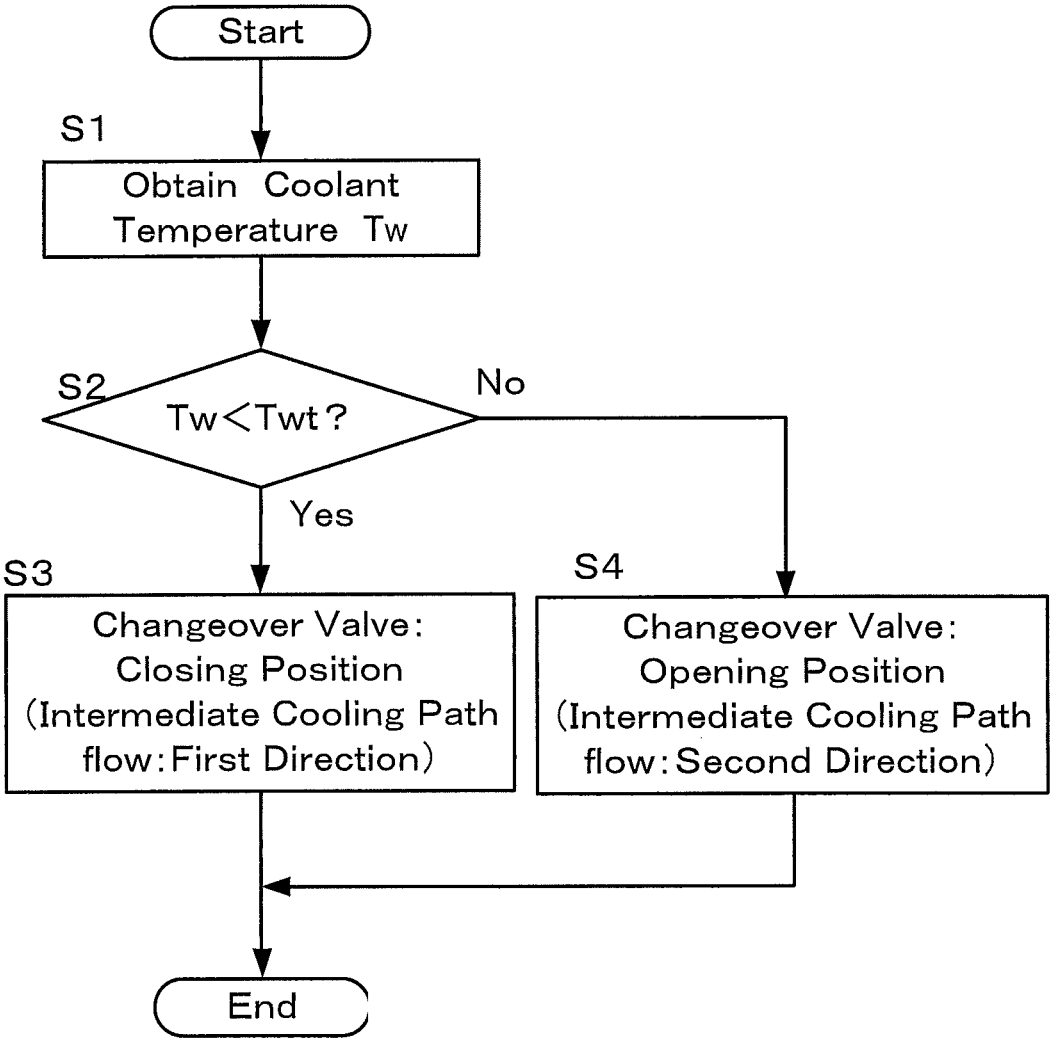
FIG. 3 is a flow chart showing an example of a control routine according to the first embodiment.

Operation to the changeover valve 21 is implemented by an engine control unit (i.e. an ECU) 30 comprising a computer that controls various sections of the engine 2. Thereby, the ECU 30 functions as the operating device of the Claims of this application. Apart from the signal from the temperature sensor 20 described above, other signals from sensors of various types are also inputted to the ECU 30. The ECU 30 implements a control routine shown in FIG. 3 in order to perform control corresponding to the present invention. The program for the control routine of FIG. 3 is stored in the ECU 30, and is repeatedly executed on a predetermined cycle.

In first step S1, the ECU 30 refers to the signal from the temperature sensor 20, and obtains the coolant temperature Tw. And next, in step S2, the ECU 30 determines whether or not the coolant temperature Tw is lower than a threshold value Twt. This threshold value Twt is set to a value which is lower than the set temperature of the thermostat 13, and also can make the temperature of the coolant supplied to the EGR cooler 4 appropriate. In other words, depending upon the driving condition of the engine 2, the threshold value Twt is set from a standpoint such that coolant should be supplied to the EGR cooler 4 at high temperature or at low temperature. For example, since in any case it is not possible to implement EGR during the engine-cold period before the engine 2 has been fully warmed up, accordingly it is desirable to supply coolant to the EGR cooler 4 at as high temperature as possible in order to suppress the generation of condensed water. On the other hand, after EGR has started, it is desirable to supply coolant to the EGR cooler 4 at as low temperature as possible, in order to enhance the efficiency of EGR operation. The threshold value Twt is set so as to conform to these demands, to the greatest possible extent.

If the coolant temperature Tw is lower than the threshold value Twt, then the flow of control proceeds to step S3. In this step S3, the ECU 30 controls the changeover valve 21 so as to put it into the valve closing position. Due to this, the direction of flow of coolant in the intermediate cooling conduit 18 becomes the first direction (refer to FIG. 1), so that coolant at comparatively high temperature that has passed through the cylinder head 3*a* is supplied to the EGR cooler 4. Accordingly, after the engine 2 has been started, it is possible to suppress the generation of condensed water in the EGR cooler 4, since it is possible to supply coolant at as high temperature as possible to the EGR cooler 4 until the coolant temperature Tw rises to become equal to or higher than the threshold value Twt.

On the other hand, if the coolant temperature Tw is greater than or equal to the threshold value Twt, then the flow of control is transferred to step S4. In this step S4, the ECU 30 controls the changeover valve 21 so as to put it into the valve opening position. Due to this, the direction of flow of coolant in the intermediate cooling conduit 18 becomes the second direction (refer to FIG. 2), so that coolant at comparatively low temperature that has passed through the cylinder block 3*b* is supplied to the EGR cooler 4. Accordingly it is possible to enhance the efficiency of EGR, since it is possible to supply coolant at as low temperature as possible when the coolant temperature Tw has become equal to or higher than the threshold value Twt.

Figure 4:
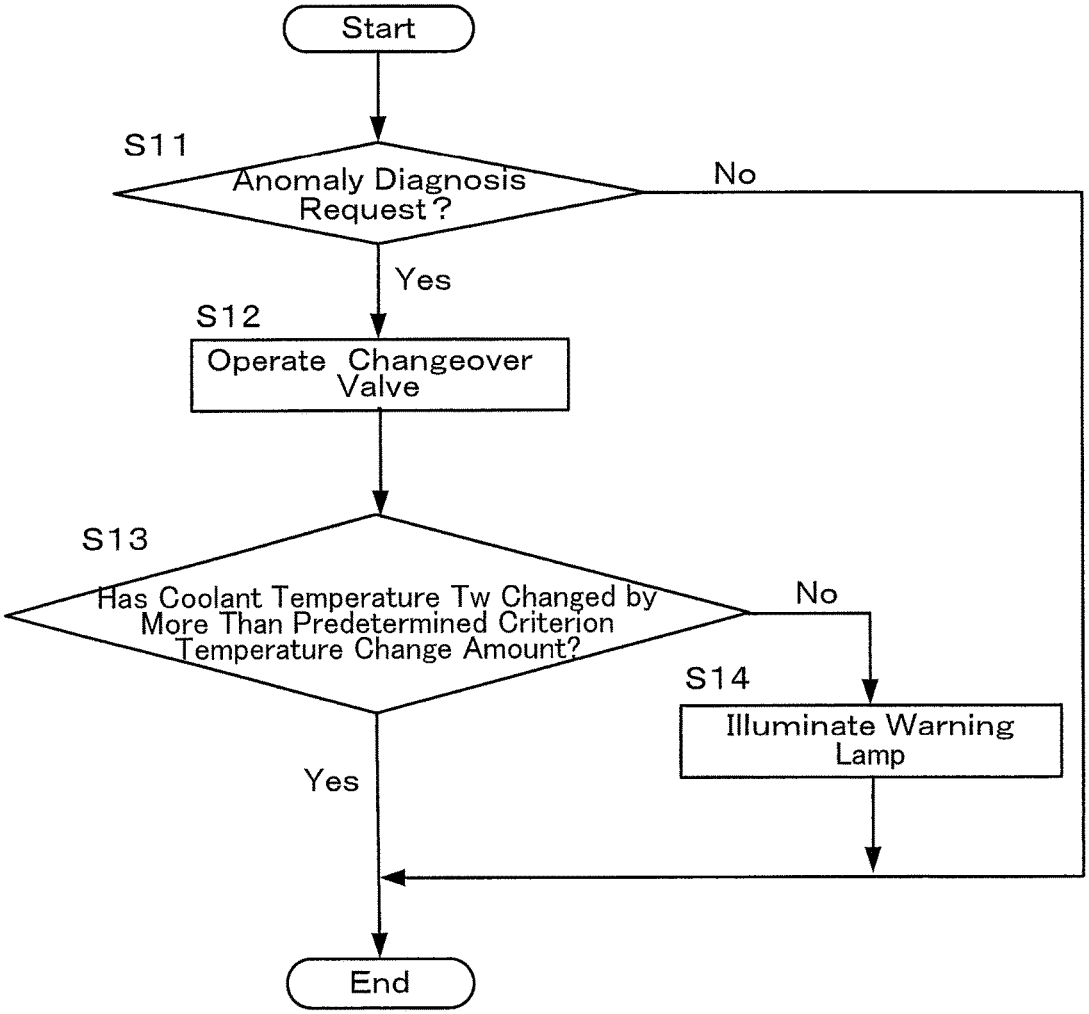
FIG. 4 is a flow chart showing an example of a control routine for determining whether an anomaly of a changeover valve is occurring.

No particular device (such as a lift sensor or the like) is provided for checking upon the movement of the changeover valve 21, so that it is not possible to determine upon the occurrence of an anomaly of the changeover valve 21 by employing such a checking device. Accordingly, by implementing the control routine shown in FIG. 4, the ECU 30 also functions as a diagnosis device for determining whether or not an anomaly of the changeover valve 21 is occurring. The program for the control routine of FIG. 4 is stored in the ECU 30, and is repeatedly implemented on a predetermined cycle.

In a step S11, the ECU 30 determines whether or not there is any request for a decision to be made as to whether or not an anomaly of the changeover valve 21 is occurring (this request may be termed an "anomaly diagnosis request"). For example, an anomaly diagnosis request may be generated if a predetermined condition is satisfied, such as a condition that total driving hours of the engine 2 accumulated from a moment when the previous anomaly diagnosis request was generated exceed a predetermined number of hours, or the like. If there is such anomaly diagnosis request, then the flow of control proceeds to step S12, whereas if there is no such request then the subsequent processing is skipped and this cycle of the FIG. 4 routine terminates.

In step S12, the ECU 30 operates the changeover valve 21 so as to put it into the valve closing position if its current position is the valve opening position, and so as to put it into the valve opening position if its current position is the valve closing position. And in the next step S13 the ECU 30 determines whether or not the coolant temperature Tw has changed by more than a predetermined criterion change amount between moments before and after the operation to the changeover valve 21 implemented in step S12. When the position of the changeover valve 21 changes, as described above, the direction of flow of coolant in the intermediate cooling conduit 18 changes, and according thereto the temperature of the coolant flowing in the intermediate cooling conduit 18 changes. Accordingly, it is possible to determine whether or not an anomaly of the changeover valve 21 is occurring, on the basis of correlation between the change of the temperature within the intermediate cooling conduit 18 and the operation to the changeover valve 21. As the criterion for determining whether or not an anomaly of the changeover valve 21 is occurring, for example, a lower limit value may be set as the amount of change of the coolant temperature Tw which was measured in a case the changeover valve 21 was changed over normally.

If in step S13 it is determined that if the coolant temperature Tw has changed by an amount that exceeds the predetermined criterion change amount, then this cycle of the routine is terminated, since the changeover valve 21 has been proved to be moving normally. On the other hand, if the coolant temperature Tw has only changed by less than the predetermined criterion change amount, then, since it appears that the changeover valve 21 has not moved normally, accordingly the flow of control proceeds to step S14, in which the ECU 30, for example, illuminates a warning lamp in order to inform the driver of the vehicle that an anomaly of the changeover valve is occurring. In this manner, according to the processing of the control routine of FIG. 4, it is possible to determine whether or not an anomaly of the changeover valve 21 is occurring, without actually detecting the movement of the changeover valve 21 itself as such.

Embodiment #2

Figure 5:
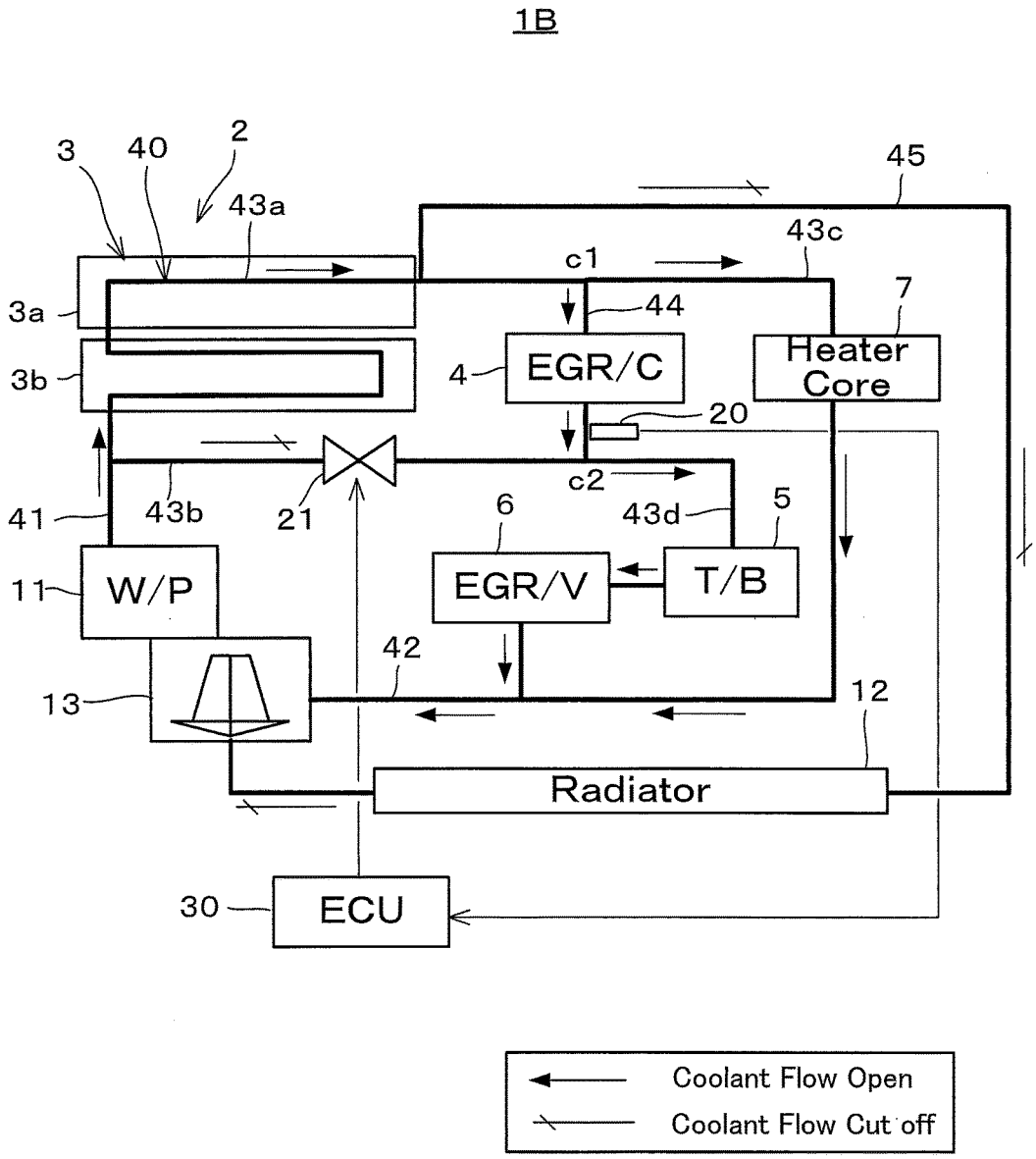
FIG. 5 is a figure schematically showing a cooling apparatus for an engine according to a second embodiment.
Figure 6:
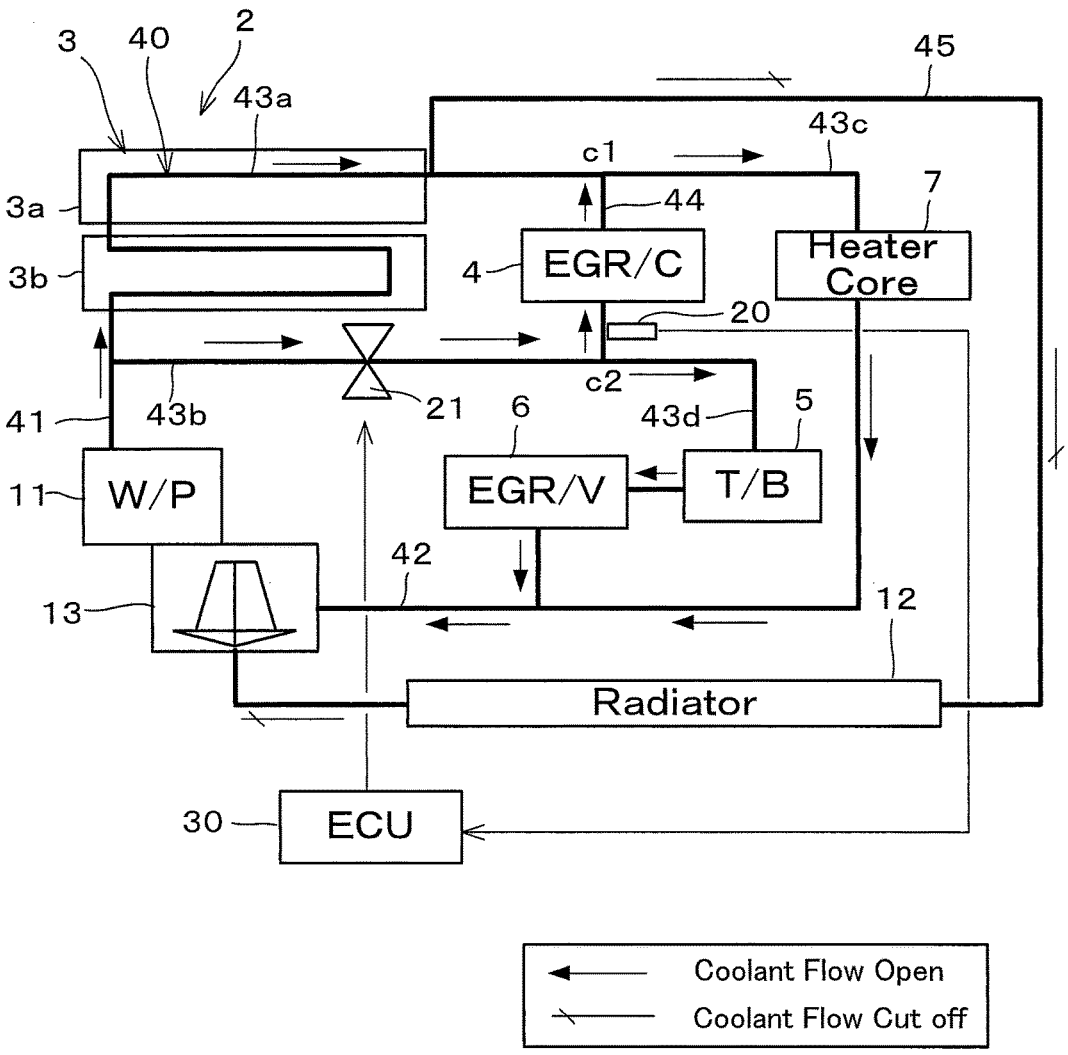
FIG. 6 is a figure showing a state of the cooling apparatus of FIG. 5, in which the direction of coolant flowing in an intermediate cooling conduit is changed over.

Next, a second embodiment of the present invention will be explained with reference to FIG. 5 and FIG. 6. The cooling apparatus 1B according to this second embodiment is the same as the cooling apparatus 1A according to the first embodiment, with the exception of the structure of the cooling path. In the following, to elements which are the same or similar to the first embodiment, the same reference symbols are appended in the figures, and explanation thereof will be omitted.

The cooling apparatus 1B comprises a cooling path 40 for making coolant circulate using a coolant pump 11. The cooling path 40 includes a downstream side connection conduit 41 that is connected to the downstream side of the coolant pump 11, and an upstream side connection conduit 42 that is connected to the upstream side of the coolant pump 11. Moreover, the cooling path 40 comprises: a first cooling conduit 43*a* that branches off from the downstream side connection conduit 41 and cools a cylinder head 3*a* and a cylinder block 3*b* of the engine main body 3; a second cooling conduit 43*b* that branches off from the downstream side connection conduit 41 and is provided in parallel with the first cooling conduit 43*a* so as to detour around the engine main body 3; an intermediate cooling conduit 44 that is connected to the first cooling conduit 43*a* and to the second cooling conduit 43*b*, and is provided with an EGR cooler 4 that constitutes a device to be cooled; a third cooling conduit 43*c* that runs from the position of connection c1 of the first cooling conduit 43*a* and the intermediate cooling conduit 44 to the upstream side connection conduit 42; and a fourth cooling conduit 43*d* that runs from the position of connection c2 of the intermediate cooling conduit 44 and the second cooling conduit 43*b* to the upstream side connection conduit 42. Since the first cooling conduit 43*a* passes through the cylinder head 3*a* and through the cylinder block 3*b*, while the second cooling conduit 43*b* detours around the engine main body 3, accordingly the first cooling conduit 43*a* may be considered as being a cooling conduit that receives a substantially greater amount of heat into its coolant than does the second cooling conduit 43*b*. A radiator flow path 45 branches off from the first cooling conduit 43*a*, and this radiator flow path 45 comes together with the upstream side connection conduit 42.

In a similar manner to the case with the first embodiment, the cooling apparatus 1B comprises a changeover valve 21 that is provided in the second cooling conduit 43*b*, and the direction in which coolant flows in the intermediate cooling conduit 44 can be changed over between a first direction (refer to FIG. 5) and a second direction (refer to FIG. 6) by this changeover valve 21 being operated to change over between the valve closing position and the valve opening position. Operation of the changeover valve 21 is implemented by the ECU 30. By the ECU 30 implementing the control routines of FIG. 3 and FIG. 4, in a similar manner to the case with the first embodiment, it is possible to implement similar control to that of the first embodiment, and it is possible to obtain similar beneficial effects to those obtained with the first embodiment.

The present invention is not to be considered as being limited to the embodiments described above; it could be implemented in various different ways, provided that the scope of its gist is not departed from. While an EGR cooler is provided in the embodiments described above as the device to be cooled, this is one of examples; devices of various types could be provided in the intermediate cooling conduit as the device to be cooled. Moreover, in the embodiments described above, the changeover valve that is provided as the flow resistance regulation device in the second cooling conduit is only cited by way of example. The present invention may be implemented by providing the flow resistance regulation device in any one of the first cooling conduit, the second cooling conduit, the third cooling conduit, and the fourth cooling conduit. It is still possible to change over the direction of flow of coolant in the intermediate conduit by operating the flow resistance regulation device, even if the flow resistance regulation device is provided in some conduit other than the second cooling conduit. The reason why this is the case will now be explained with reference to FIG. 7 and other figures.

Figures 7, 8:
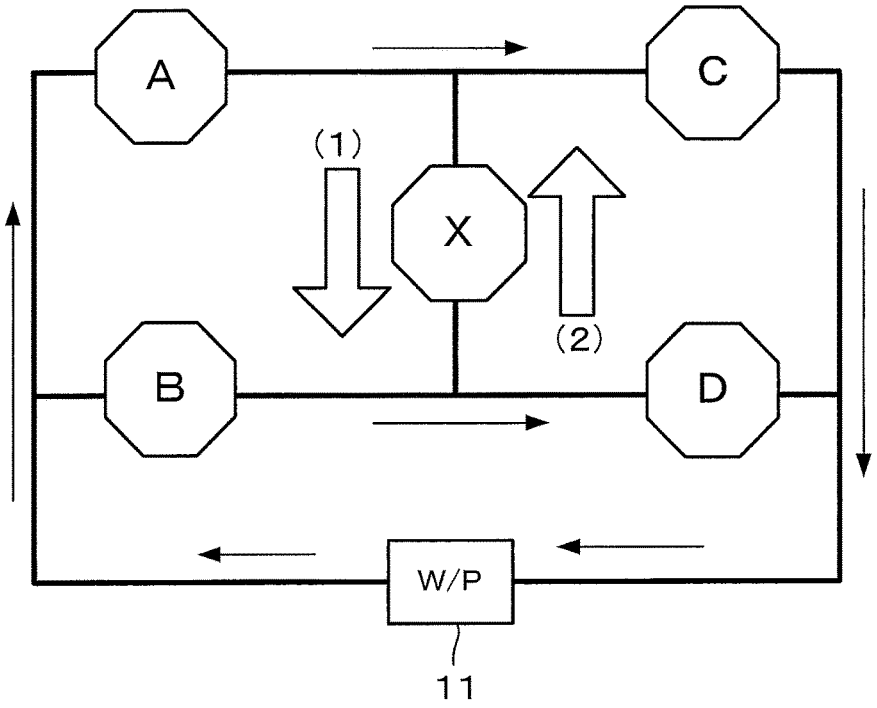
FIG. 7 is an explanatory figure in which the cooling path has been simplified.
FIG. 8 is a table showing a correspondence relationship between the state of a changeover valve and the direction in which coolant flows in the intermediate cooling conduit.

In order to simplify the cooling conduits, the area of the first cooling conduit will be denoted by "A", the area of the second cooling conduit will be denoted by "B", the area of the third cooling conduit will be denoted by "C", the area of the fourth cooling conduit will be denoted by "D", and the device to be cooled which is provided in the intermediate cooling conduit will be termed "X", as shown in FIG. 7. And when coolant flows in the intermediate cooling conduit from the first cooling conduit toward the second cooling conduit, that direction will be termed the "first direction (1)", while, when coolant flows in the intermediate cooling conduit from the second cooling conduit toward the first cooling conduit, that direction will be termed the "second direction (2)". By changing the proportion of the flow resistances of the areas A through D, the direction of flow of coolant in the intermediate cooling conduit can be changed between the first direction and the second direction. In other words, if the product of the flow resistances of the area A and the area D is defined as being A×D and the product of the flow resistances of the area B and the area C is defined as being B×C, then the flow direction in the intermediate cooling conduit becomes the first direction (1) when the relation $A \times D < B \times C$ holds, whereas the flow direction in the intermediate cooling conduit becomes the second direction (2) when the relation $A \times D > B \times C$ holds. Moreover, when the condition $A \times D = B \times C$ holds, it is possible to substantially stop the flow of coolant in the intermediate cooling conduit.

Accordingly, it is possible to change over the direction of flow of coolant in the intermediate cooling conduit between the first direction and the second direction by changing the flow resistance of at least one of the areas A through D, thus selectively making any one of the above described magnitude relationships be satisfied. For example, if a similar changeover valve to the one employed in the first embodiment or in the second embodiment is provided to any one of the areas A through D, then the correspondence relationship between the state of the changeover valve and the direction of flow of coolant in the intermediate cooling conduit will become as shown in FIG. 8. However, each of the flow resistances of the areas A through D is set so that in a case that the changeover valve provided in the area A or in the area D is at the valve opening position, the direction of flow of coolant in the intermediate cooling conduit will become the first direction, while, in a case the changeover valve provided in the area B or in the area C is at the valve opening position, the direction of flow of coolant in the intermediate cooling conduit will become the second direction. The case in which the changeover valve is provided in the area B corresponds to the first embodiment or to the second embodiment. For example, if the changeover valve is provided in the area D, then the direction of the flow of coolant in the intermediate cooling conduit becomes the first direction (1) when the changeover valve is at the valve opening position, while it becomes the second direction (2) when the changeover valve is at the valve closing position.

As explained above, by appropriately arranging appropriate equipment matched to the temperatures and to the flow rate states of the coolant in the areas A through D, it becomes possible to satisfy the demands for cooling the device to be cooled that is provided in the intermediate cooling conduit, within the limits of possibility.

Figure 9:
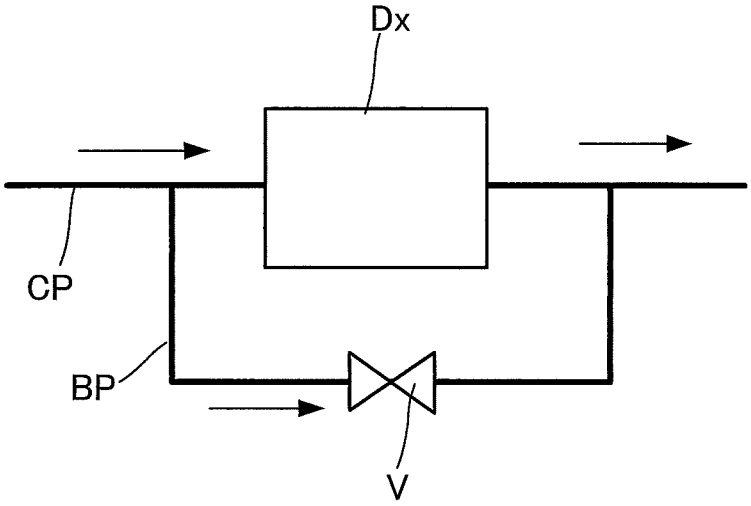
FIG. 9 is a figure showing another embodiment of a flow resistance regulation device.

While it is acceptable to provide the changeover valve in any one of the areas A through D, it would also be possible to provide a plurality of changeover valves, for example to provide one changeover valve in the area A and one changeover valve in the area B, or the like. Moreover, for the flow resistance regulation device, it would also be possible to employ a valve device such as an electromagnetic valve or the like whose opening amount can be adjusted continuously between a fully valve closing position and a fully valve opening position, rather than employing a changeover valve of the two-position type described above. Furthermore, as shown in FIG. 9, it would also be possible, to a cooling conduit CP in which any device Dx is disposed, to provide a bypass conduit BP that bypasses that device Dx, and also to provide a valve device V in the bypass conduit BP, such as the changeover valve described above or an electromagnetic valve or the like. If such a valve device V is provided in parallel with a device Dx in this manner, then the combination of the bypass conduit BP and the valve device V will correspond to the "flow resistance regulation device" in the Claims of this application.

While in the embodiments described above the presence of an anomaly of the changeover valve, which functions as a flow resistance device, is determined on the basis of the temperature of the coolant flowing in the intermediate flow conduit as detected by the temperature sensor that is provided in the intermediate flow conduit, it would also be possible to direct attention to change of the flow rate of coolant flowing in the intermediate cooling conduit due to the operation to the flow resistance regulation device, and to determine the presence of an anomaly of the flow resistance regulation device on the basis of correlation between the operation to the flow resistance regulation device and a pressure within the intermediate cooling conduit. Moreover, the present invention is not to be considered as being limited to a form in which change of the temperature or the pressure within the intermediate flow conduit is directly measured by a temperature sensor or by a pressure sensor; it would also be possible to obtain either of these changes by estimating it from one or more parameters other than the temperature or the pressure.

While, in the embodiments described above, the changeover valve is operated electrically in order for them to serve as the flow resistance regulation device, it would also be possible to implement the present invention in a form in which the flow resistance regulation device is not electrically operated, by providing, as the flow resistance regulation device, a thermo-valve that performs an opening motion or a closing motion depending on the temperature of the coolant, and setting the temperature at which this thermo-valve opens as appropriate.

What is claimed:

1. A cooling apparatus for an engine that comprises a cooling path through which coolant flows to circulate by a coolant pump for cooling an engine main body and a device to be cooled, the cooling path comprising a downstream side connection conduit that is connected to a downstream side of the coolant pump, an upstream side connection conduit that is connected to an upstream side of the coolant pump, a first cooling conduit that branches off from the downstream side connection conduit and cools at least one portion of the engine main body, a second cooling conduit that branches off from the downstream side connection conduit and is provided in parallel with the first cooling conduit, an intermediate cooling conduit that is connected to the first cooling conduit and to the second cooling conduit and is provided with the device to be cooled, a third cooling conduit that runs from a position of connection of the intermediate cooling conduit and the first cooling conduit to the upstream side connection conduit, and a fourth cooling conduit that runs from a position of connection of the intermediate cooling conduit and the second cooling conduit to the upstream side connection conduit, the cooling apparatus further comprising:

a flow resistance regulation device provided in any one of the first cooling conduit, the second cooling conduit, the third cooling conduit, and the fourth cooling conduit, to regulate flow resistance, the flow resistance regulation device making, by a motion of the flow resistance regulation device, a change of direction in which coolant flows in the intermediate cooling conduit is changed over between a first direction from the first cooling conduit towards the second cooling conduit, and a second direction from the second cooling conduit towards the first cooling conduit, and a changeover valve as the flow resistance regulation device, and wherein the flow resistances of the first cooling conduit, the second cooling conduit, the third cooling conduit and the fourth cooling conduit are set so that coolant flows in the intermediate cooling conduit in the first direction when the changeover valve provided in the first cooling conduit or in the fourth cooling conduit is at a valve opening position.

2. A cooling apparatus for an engine that comprises a cooling path through which coolant flows to circulate by a coolant pump for cooling an engine main body and a device to be cooled, the cooling path comprising a downstream side connection conduit that is connected to a downstream side of the coolant pump, an upstream side connection conduit that is connected to an upstream side of the coolant pump, a first cooling conduit that branches off from the downstream side connection conduit and cools at least one portion of the engine main body, a second cooling conduit that branches off from the downstream side connection conduit and is provided in parallel with the first cooling conduit, an intermediate cooling conduit that is connected to the first cooling conduit and to the second cooling conduit and is provided with the device to be cooled, a third cooling conduit that runs from a position of connection of the intermediate cooling conduit and the first cooling conduit to the upstream side connection conduit, and a fourth cooling conduit that runs from a position of connection of the intermediate cooling conduit and the second cooling conduit to the upstream side connection conduit, the cooling apparatus further comprising:

a flow resistance regulation device provided in any one of the first cooling conduit, the second cooling conduit, the third cooling conduit, and the fourth cooling conduit, to regulate flow resistance, the flow resistance regulation device making, by a motion of the flow resistance regulation device, a change of direction in which coolant flows in the intermediate cooling conduit is changed over between a first direction from the first cooling conduit towards the second cooling conduit, and a second direction from the second cooling conduit towards the first cooling conduit, and a changeover valve as the flow resistance regulation device, and wherein the flow resistances are set so that coolant flows in the intermediate cooling conduit in the second direction when the changeover valve provided in the second cooling conduit or in the third cooling conduit is at the valve opening position.

3. The cooling apparatus according to claim 1, further comprising an electronic control unit including a computer for implementing a computer program and configured to receive input from a plurality of sensors located on the engine, the electronic control unit programmed to:

operate the flow resistance regulation device; and determine an anomaly of the flow resistance regulation device on the basis of correlation between operation to the flow resistance regulation device and change of temperature or of pressure within the intermediate cooling conduit.

4. The cooling apparatus according to claim 1, wherein the engine main body includes a cylinder head and a cylinder block, the device to be cooled is an EGR cooler, and the first cooling conduit cools the cylinder head while the second cooling conduit cools the cylinder block.

5. The cooling apparatus according to claim 2, further comprising an electronic control unit including a computer for implementing a computer program and configured to receive input from a plurality of sensors located on the engine, the electronic control unit programmed to:

operate the flow resistance regulation device; and determine an anomaly of the flow resistance regulation device on the basis of correlation between operation to the flow resistance regulation device and change of temperature or of pressure within the intermediate cooling conduit.

6. The cooling apparatus according to claim 2, wherein the engine main body includes a cylinder head and a cylinder block, the device to be cooled is an EGR cooler, and the first cooling conduit cools the cylinder head while the second cooling conduit cools the cylinder block.

* * * * *